US007303512B1

(12) United States Patent
Goldman et al.

(10) Patent No.: US 7,303,512 B1
(45) Date of Patent: Dec. 4, 2007

(54) POGO BALL

(75) Inventors: Michael Goldman, Mt. Laurel, NJ (US); Jack Lovewell, Kunkletown, PA (US); Harold Frankel, Mt. Laurel, NJ (US)

(73) Assignee: Tucker Toys, Inc., Voorhees, NJ (US)

( * ) Notice: Subject to any disclaimer, the term of this patent is extended or adjusted under 35 U.S.C. 154(b) by 0 days.

(21) Appl. No.: 11/439,101

(22) Filed: May 23, 2006

(51) Int. Cl.
*A63B 25/08* (2006.01)
*A63B 21/02* (2006.01)

(52) U.S. Cl. ..... 482/77; 482/123; 472/135

(58) Field of Classification Search ..... 482/77–78, 482/121–126, 148; D21/413; 472/135; 446/486

See application file for complete search history.

(56) References Cited

U.S. PATENT DOCUMENTS 1,594,479 A * 8/1926 Swofford ..... 482/77
3,179,409 A 4/1965 Marino
3,604,726 A 9/1971 Tracy
3,716,229 A 2/1973 Van Der Cleyen et al.
4,893,809 A * 1/1990 Blankenzee ..... 482/77
5,009,415 A 4/1991 Perez Blanco
5,301,441 A 4/1994 Kownacki
5,810,700 A * 9/1998 Orcutt ..... 482/123
5,897,474 A 4/1999 Romero
6,346,065 B1 * 2/2002 Lapointe ..... 482/77
6,475,125 B1 * 11/2002 Roberts ..... 482/123
6,758,793 B2 7/2004 Eldridge
6,835,168 B2 * 12/2004 Huang ..... 482/123
6,872,175 B2 3/2005 Lin

* cited by examiner

*Primary Examiner*—Fenn C. Mathew
(74) *Attorney, Agent, or Firm*—Norman E. Lehrer

(57) ABSTRACT

An amusement device that includes an elastic ball, a rigid, generally rectangular platform surrounding the ball so as to give the ball a figure eight appearance, an elongated elastic handle extending upwardly from the center of the ball, and a plurality of straps releasably securing the handle to the platform. The handle includes an upper section, a lower section, and a bar extending generally horizontally outwardly from the upper section of the handle. The bar may be grasped by a person while bouncing on the ball. The handle and the ball are made from an elastic material such as rubber.

6 Claims, 3 Drawing Sheets

POGO BALL

BACKGROUND OF THE INVENTION

The present invention is directed toward an amusement device that allows a person to bounce using a ball and more particularly, toward a device that allows a person to bounce freely in a controlled manner without undue restraint.

Children of all ages enjoy the weightless feel of bouncing. For example, pogo sticks, trampolines, and moon bouncers, all amuse children of various ages because the child is able to bounce in the air, seemingly without restraint. A traditional pogo stick, however, is somewhat rigid and does not provide a very elastic movement. Moon bouncers are a favorite among younger children however they are rather large so that individuals tend not to own them. They are more often rented or found at fairs, amusement parks, or the like. While trampolines are often owned by individuals, they are rather large and are not easily portable.

Various types of smaller, very elastic amusement devices are known. For example, U.S. Pat. No. 3,716,229 to Van Der Cleyen et al. discloses a jump ball that includes a disk-shaped foot support that extends around an inflatable ball so as to give the ball a substantially figure eight shape. A person stands on the foot support and pushes his or her ankles against the ball to retain it in place and then jumps up and down like a pogo stick. But unlike a pogo stick, this invention does not have a handle so that a person must balance on the ball unaided. This makes it somewhat difficult to use and can create a potentially dangerous situation.

U.S. Pat. No. 4,893,809 to Blankenzee also discloses a jump ball that includes an inflatable, flexible ball with a rigid plate that surrounds the ball. A person stands on the plate in order to jump up and down. Again, however, this action may be dangerous because of the limited control as the person has nothing to hold on to as he or she is jumping. The apparatus is also difficult to use for many people.

U.S. Pat. No. 3,179,409 to Marino discloses an elastic amusement device that includes a ball with a frame partially surrounding the ball with a rigid handle extending upwardly from the frame. A person stands on the frame, holds the handle, and bounces. However, the ball is essentially encased by the frame thereby limiting the expansion and movement of the ball so that the ball cannot move as freely when a person is bouncing thereon. The rigid handle also makes the devices somewhat uncomfortable to use as it does not absorb the shock from the bouncing ball but, rather, transfers it to the arms and upper body of the person using the same. The rigid handle itself can also potentially cause injury to the person using the device if he or she should fall on the same.

A need exists, therefore, for a bouncing amusement toy or device that is comfortable to use and which allows the person to freely bounce in a controlled and safe manner.

SUMMARY OF THE INVENTION

The present invention is designed to overcome the deficiencies of the prior art discussed above. It is an object of the present invention to provide an amusement device that allows a person to bounce using a ball.

It is another object of the present invention to provide an amusement device that is easier to use but also provides the excitement of bouncing on a ball.

It is a further object of the present invention to provide an amusement device that allows the user to bounce in a controlled manner and which increases the user's confidence and performance.

In accordance with the illustrative embodiments demonstrating features and advantages of the present invention, there is provided an amusement device that includes an elastic ball, a rigid, generally rectangular platform surrounding the ball so as to give the ball a figure eight appearance, an elongated elastic handle extending upwardly from the ball, and means for releasably mounting the handle onto the ball. The mounting means includes a plurality of straps with at least one of the straps having a releasable buckle secured thereto. The straps are secured to the platform adjacent the ball. The handle includes an upper section, a lower section, and a pair of bars extending generally horizontally outwardly from the upper section of the handle. The bars are adapted to be grasped by a person while bouncing on the ball. The handle and the ball are made from an elastic rubber-like material.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 2:
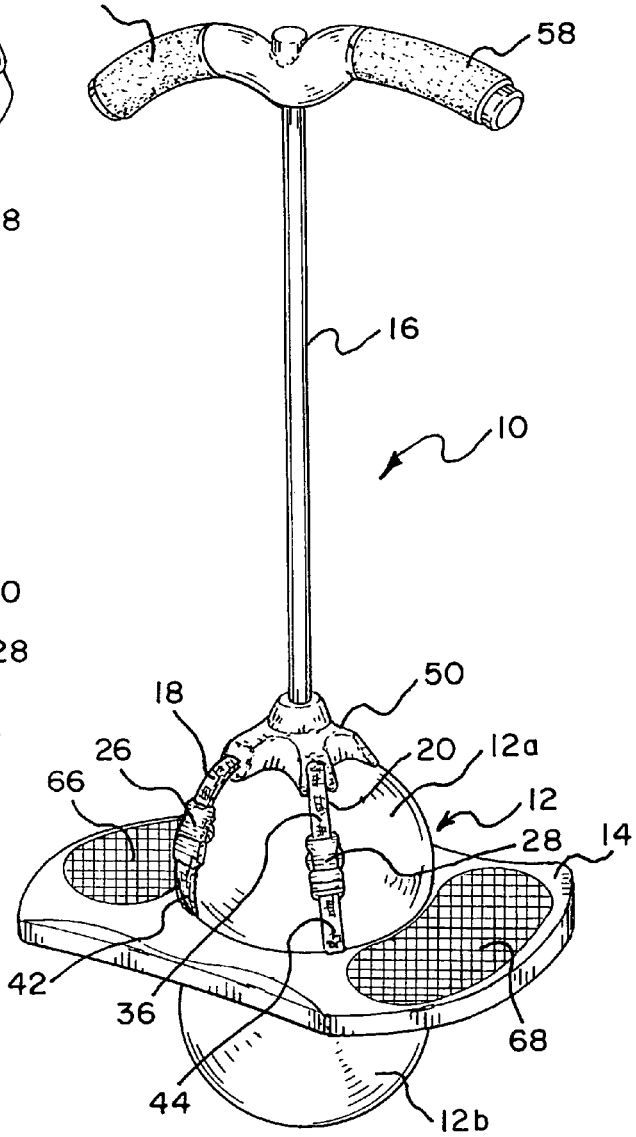
FIG. 2 is a front perspective view of the amusement device of the present invention.

Referring now to the drawings in detail wherein like reference numerals have been used throughout the various figures to designate like elements, there is shown in FIG. 2 an amusement device constructed in accordance with the principles of the present invention and designated generally as 10.

Figure 5:
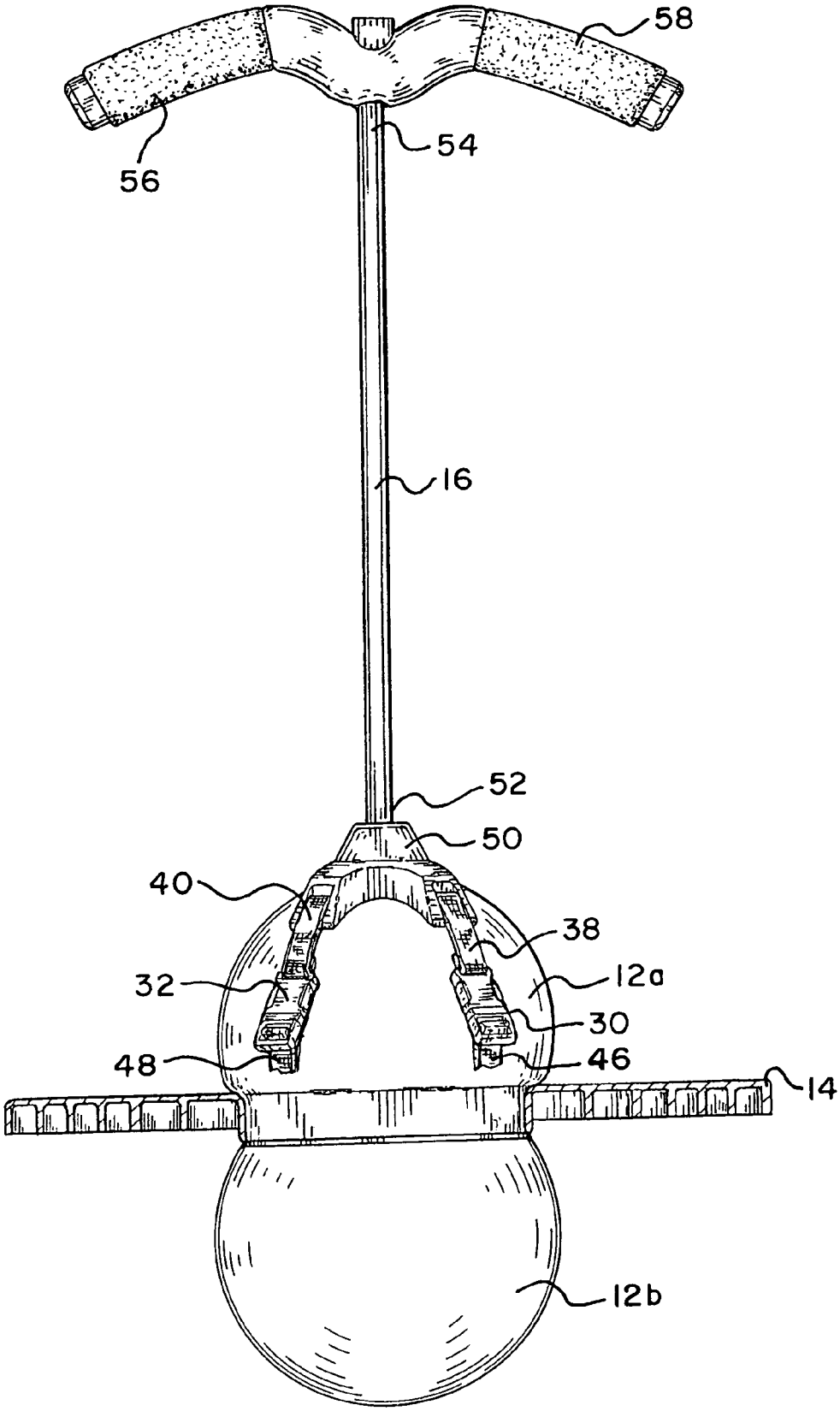
FIG. 5 is a front elevational view shown partially in cross-sectional of the amusement device of the present invention.

The amusement device 10 of the present invention generally includes an elastic ball 12, a rigid, generally rectangular platform 14 surrounding the ball 12 so as to give the ball 12 a substantially figure eight appearance, an elongated, elastic handle 16 extending upwardly from the ball 12, and means for releasably mounting the handle 16 on the ball 12. The ball 12 is made from an elastic material such as rubber or a synthetic rubber or similar material. The platform 14, on the other hand, is preferably made of a rigid plastic material that is strong enough to support a person standing thereon and includes a central opening passing therethrough. The ball 12 is located in the central opening of the platform 14 with the top half 12*a* of the ball 12 extending above the platform 14 and the bottom half 12*b* of the ball 12 extending below the platform 14. (See FIG. 5.)

Figure 3:
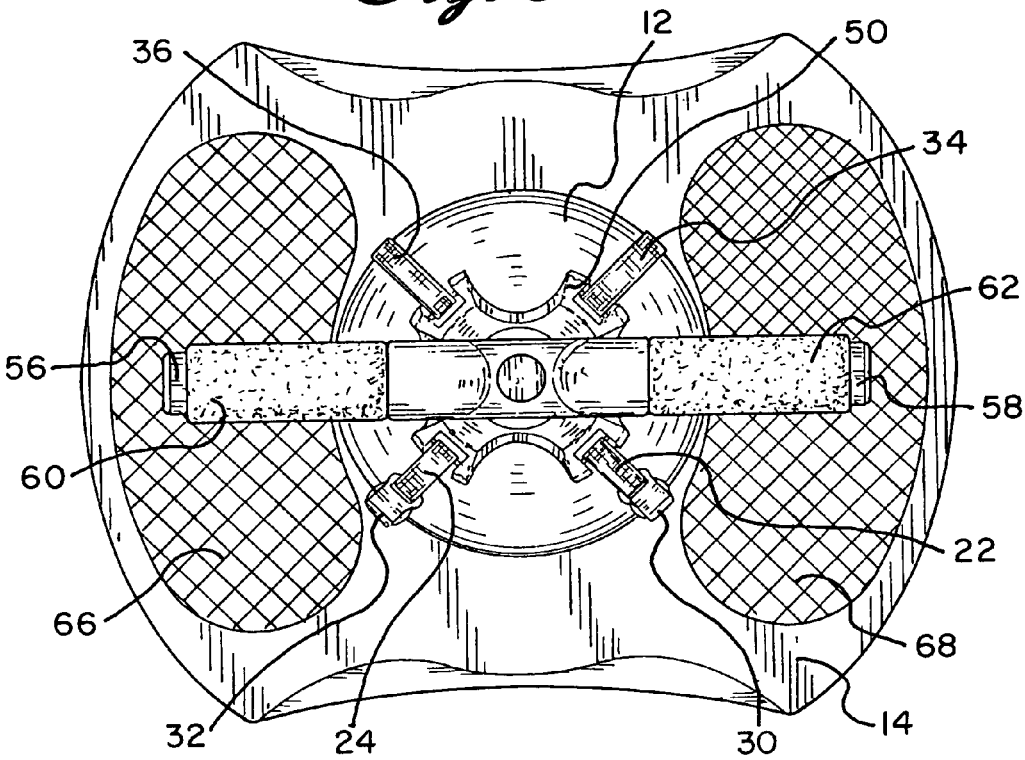
FIG. 3 is a top plan view of the amusement device of the present invention.
Figure 4:
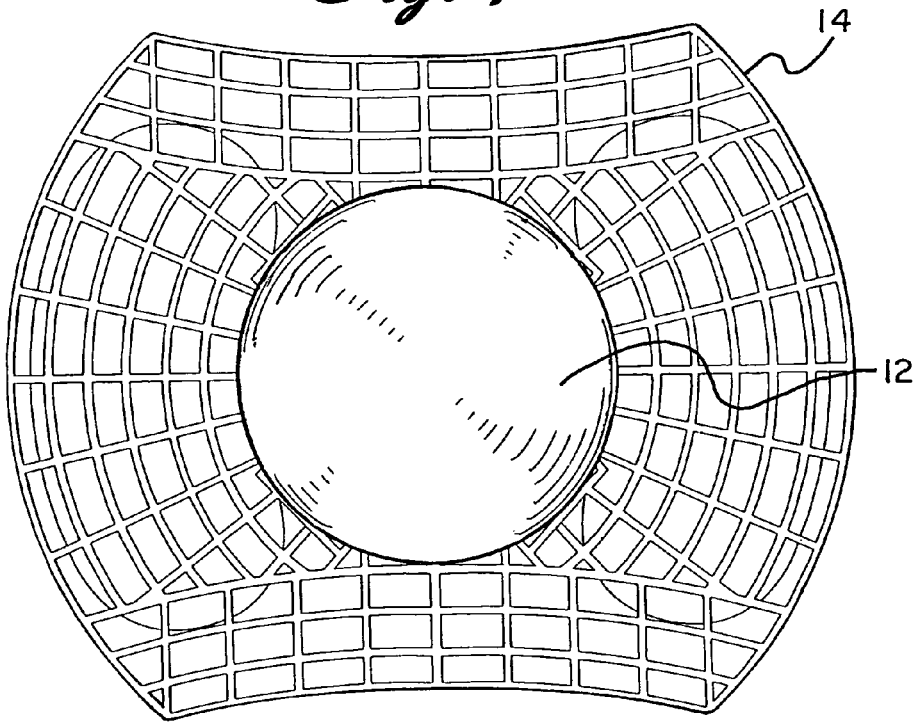
FIG. 4 is a bottom plan view of the amusement device of the present invention.

The mounting means for the handle 16 includes a plurality of straps 18, 20, 22, and 24. Each strap 18, 20, 22, and 24 has a releasable buckle 26, 28, 30, and 32, respectively, secured thereto. The straps 18, 20, 22, and 24 are secured to the underside of the platform 14 and pass upwardly therethrough adjacent the central opening around the ball 12. (See FIGS. 3 and 4.) Each strap 18, 20, 22, and 24 also has a first upper member 34, 36, 38, and 40 and a second lower member 42, 44, 46, and 48, respectively. The upper members 34, 36, 38, and 40 of the straps 18, 20, 22, and 24 are equally spaced around and are secured to and extend downwardly from a rigid cap 50. The cap 50 fits onto the top of the ball 12 and is attached to the lower section 52 of the handle 16 in such a way the handle is concentric with the ball 12 and extends upwardly from the center of the amusement device 10. The lower members 42, 44, 46, and 48 of the straps 18, 20, 22, and 24 extend upwardly from the lower surface of the platform 14 as explained above and are in line with the upper members. Each first member 34, 36, 38, and 40 and its respective second member 42, 44, 46, and 48 are joined by a respective releasable buckle 28, 28, 30, and 32. The straps 18, 20, 22, and 24 essentially encircle the upper top half 12*a* of the ball 12.

Figure 1:
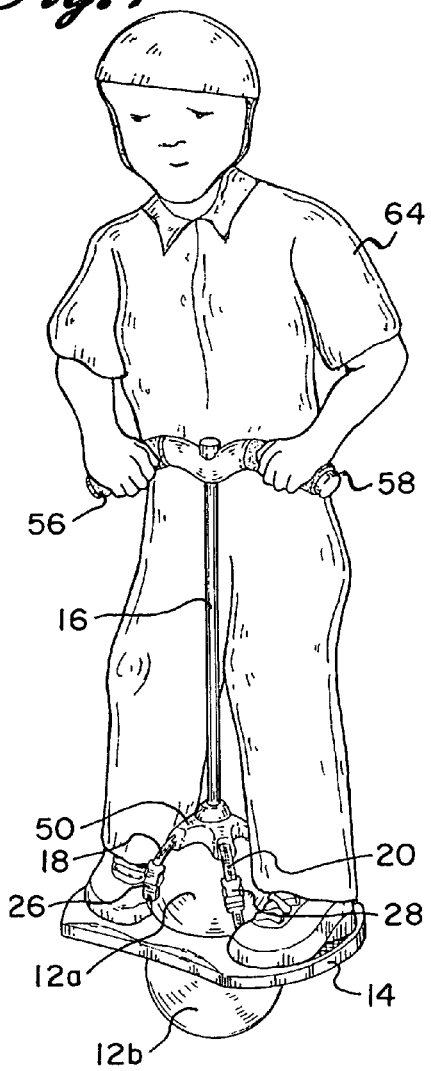
FIG. 1 illustrates a person using the amusement device of the present invention.

The handle 16 includes a lower section 52, an upper section 54, and a pair of bars 56 and 58 extending generally horizontally outwardly from the upper section 54 of the handle 16. (See FIG. 5.) The length of the handle 16 throughout the lower section 52 and the upper section 54 is normally flaccid and is made from an elastic material such as natural or synthetic rubber. The bars 56 and 58 are generally rigid and may have hand grips 60 and 62, respectively, which are adapted to be grasped by a person while bouncing on the ball 12. (See FIG. 1.)

In order to use the amusement device 10, a person 64 stands on the platform 14 with one foot on either side of the ball 12, grasps the bars 56 and 58 and pulls upwardly slightly to put some tension on the handle 16. (See FIG. 1.) The person 64 may now bounce while trying to balance on the platform 14. The elasticity of the handle 16 provides an increased bouncing effect, helps the person to balance and absorbs shock that otherwise might be transferred from the platform 14 to the person's upper body. The elasticity of the handle also provides constant tension thereby allowing the person's feet to stay securely on the platform while performing jumping maneuvers.

As pointed out above, the platform 14 is preferably made from a rigid plastic material. However, order to provide traction or more stable footing for the person 64 he platform 14 may also have grid-like patterns 66 and 68 and or a rubber upper surface. (See FIG. 3.)

The present invention may be embodied in other specific forms without departing from the spirit or essential attributes thereof and accordingly, reference should be made to the appended claims rather than to the foregoing specification as indicating the scope of the invention.

We claim:

1. An amusement device comprising:

an elastic ball having a top half and a bottom half;

a rigid platform surrounding said ball so that said top half extends above said platform and said bottom half extends below said platform, giving said ball a figure eight appearance;

a flexible, elongated elastic handle extending upwardly from the center of said ball; and means for mounting said elastic handle to said platform, said mounting means including a plurality of straps having upper portions and lower portions, said upper portions being connected to said handle and said lower portions being secured to said platform.

2. The amusement device as claimed in claim 1 wherein said plurality of straps are equally spaced around said ball and essentially encircle the top half of said ball.

3. The amusement device as claimed in claim 2 wherein at least one of said straps includes a means for releasably connecting the upper portion thereof to the lower portion thereof.

4. The amusement device as claimed in claim 1 wherein said platform is generally rectangular.

5. The amusement device as claimed in claim 1 wherein said handle includes an upper section, a lower section, and a pair of bars extending generally horizontally outwardly from said upper section of said handle, said bars being adapted to be grasped by a person while bouncing on said ball.

6. The amusement device as claimed in claim 1 wherein said handle is made from an elastic material.

* * * * *